US005559076A

United States Patent [19]

Evans et al.

[11] Patent Number: 5,559,076

[45] Date of Patent: Sep. 24, 1996

[54] THERMAL DYE TRANSFER SYSTEM CONTAINING A N-ARYLIMIDOETHYLIDENE-BENZ[C,D]INDOLE DYE PRECURSOR

[75] Inventors: Steven Evans, Rochester; Helmut Weber, Webster, both of N.Y.

[73] Assignee: Eastman Kodak Company, Rochester, N.Y.

[21] Appl. No.: 467,252

[22] Filed: Jun. 6, 1995

[51] Int. Cl.[6] ..... B41M 5/035; B41M 5/38

[52] U.S. Cl. ..... 503/227; 428/195; 428/480; 428/500; 428/913; 428/914

[58] Field of Search ..... 8/471; 428/195, 428/480, 500, 913, 914; 503/227

[56] References Cited

U.S. PATENT DOCUMENTS 4,137,042 1/1979 Defago et al. ..... 8/2.5 A 4,880,769 11/1989 Dix et al. ..... 503/227

*Primary Examiner*—Bruce H. Hess

*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, the dye comprising an N-arylimido-ethylidene-benz[c,d]indole dye precursor, and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer containing an organic acid which is capable of converting the dye precursor into a cationic magenta anilinovinyl-benz[c,d]indolium dye.

16 Claims, No Drawings

THERMAL DYE TRANSFER SYSTEM CONTAINING A N-ARYLIMIDOETHYLIDENE-BENZ[C,D]INDOLE DYE PRECURSOR

This invention relates to a thermal dye transfer system and, more particularly, to an electrically neutral N-arylimidoethylidenebenz[c,d]indole dye precursor useful in thermal dye transfer imaging systems in which the receiver layer contains an acid moiety which is capable of converting the dye precursor into a cationic magenta anilinovinyl-benz[c,d]indolium dye.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements an is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders, generally referred to as "retransfer".

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

U.S. Pat. No. 4,880,769 describes the thermal transfer of a neutral, deprotonated form of a cationic dye (dye precursor) to a receiver element, followed by protonation to the cationic dye and U.S. Pat. No. 4,137,042 relates to transfer printing onto fabrics using dye precursors.

There is a problem with using the dye precursors of the prior art in that the transfer efficiency for dye precursors which form a magenta cationic dye is low.

It is an object of this invention to provide a thermal dye transfer system employing a dye-receiver having an acidic dye image-receiving layer which upon transfer of the dye forms a dye/counterion complex which is substantially immobile, which would reduce the tendency to retransfer to unwanted surfaces. It is another object of this invention to provide dye precursors which are more efficient, i.e., yield higher transferred dye densities.

This and other objects are achieved in accordance with this invention which relates to a thermal dye transfer assemblage comprising:

(a) a dye-donor element comprising a support having thereon a dye layer comprising a dye dispersed in a polymeric binder, the dye comprising an N-arylimidoethylidene-benz[c,d]indole dye precursor, and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer containing an organic acid which is capable of converting the dye precursor into a cationic magenta anilinovinyl-benz[c,d]indolium dye.

In accordance with the invention, it has been found that N-arylimido-ethylidene-benz[c,d]indole dye precursors give much higher transferred densities upon transfer to an acidic receiver than do previously described dye precursors.

In a preferred embodiment of the invention, the dye precursors have the general formula:

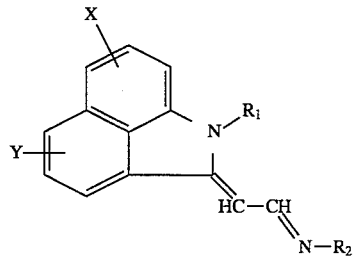

wherein:

$R_1$ represents a substituted or unsubstituted alkyl group of 1–10 carbon atoms, a substituted or unsubstituted cycloalkyl group of 5–8 carbon atoms, a substituted or unsubstituted aryl group of 6–10 carbon atoms, a substituted or unsubstituted hetaryl group of 5–10 atoms or a substituted or unsubstituted allyl group;

$R_2$ represents a substituted or unsubstituted aryl group of 6–10 carbon atoms or a substituted or unsubstituted hetaryl group of 5–10 atoms; and X and Y each independently represents hydrogen or one or more groups selected from halogen, cyano, alkyl, aryl, hetaryl, nitro, carboxy, alkoxy, aryloxy, alkoxycarbonyl, aryloxycarbonyl, acyloxy, aryloxy, amino, acylamino, arylsulfonamido, alkylsulfonamido, hydroxy, alkylcarbamoyl, dialkylcarbamoyl, arylcarbamoyl, diarylcarbamoyl, arylalkylcarbamoyl, alkylureido, arylureido, alkylthio, arylthio, etc.

In a preferred embodiment of the invention, in the above formula, $R_1$ is $CH_3$, $R_2$ is phenyl, 2,4-dimethoxyphenyl, 2-methoxy-phenyl, 4-methoxyphenyl or 2,5-dichlorophenyl, and X and Y are both hydrogen.

The above dye precursors can be readily prepared by neutralization with base (see Example of the corresponding delocalized cationic dyes which have been described as intermediates in the production of cyanine and merocyanine photographic sensitizing dyes [see Helv. Chim. Acta.,70, 1583(1987), and Khim Geterotsikl. Soedin., 340(1973) {see Chem. Abstr. 79, 39629}]. The delocalized cationic dyes may be prepared as described in these references or they may be prepared by an adaptation of the procedure described for Basic Yellow 11 on page 194 in "The Chemistry and Application of Dyes", D. R. Waring and G. Hallas (ed.), 1990, Plenum Press, New York.

The structures of the dye precursors of the invention and proposed cationic dye formed upon thermal transfer to a receiver containing an acidic moiety are illustrated below.

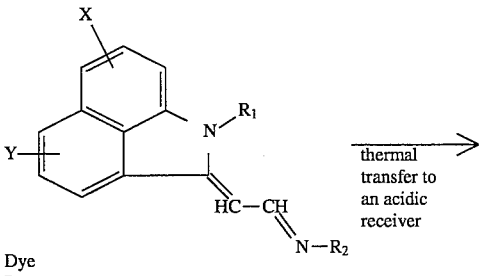

Dye Precursor

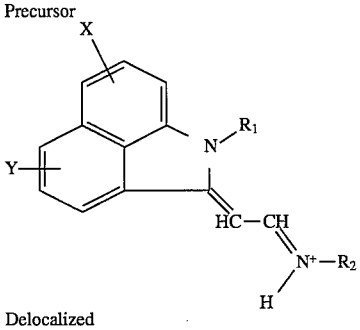

Delocalized Cationic Dye

Following are examples of the dye precursors within the scope of the invention:

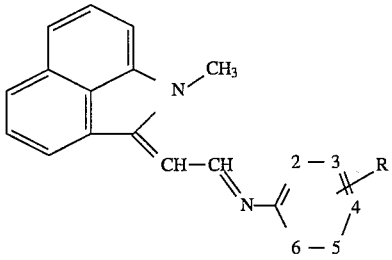

| Dye Precursor | R | λ-max (ε)* [ethanol] | λ-max (ε)* [ethanol + HCl] | Dye Molecular Weight |
|---|---|---|---|---|
| 1 | H | 479 (30,500) | 513 (40,400) | 284 |
| 2 | 2,4-$(CH_3O)_2$ | 488 (28,200) | 534 (32,000) | 332 |
| 3 | 2,5-$(Cl)_2$ | 479 (28,600) | 502 (33,000) | 353 |
| 4 | 2-$CH_3O$ | 481 (29,000) | 521 (36,400) | 314 |
| 5 | 4-$CH_3O$ | 487 (26,500) | 531 (31,700) | 314 |

*(ε) is the molar absorptivity or extinction coefficient

The polymeric dye image-receiving layer employed in the invention contains an organic acid, such as a sulfonic acid, a carboxylic acid, a phosphonic acid, a phosphoric acid or a phenol as part of the polymer chain, or contains a separately added organic acid. The polymeric dye image-receiving layer acts as a matrix for the magenta dye and the acid functionality within the dye image-receiving layer will convert the dye precursor to a magenta cationic dye.

Organic acids which can be separately added to the polymer to provide its acidic nature generally comprise ballasted organic acids, e.g., carboxylic acids such as palmitic acid, 2-(2,4-di-tert-amylphenoxy)butyric acid, etc.; phosphonic/phosphoric acids such as monolauryl ester of phosphoric acid, dioctyl ester of phosphoric acid, dodecylphosphonic acid, etc.; sulfonic acids such as hexadecanesulfonic acid, p-octyloxybenzenesulfonic acid; a phenol such as 3,5-di-tert-butyl-salicylic acid, etc.

Any type of polymer may be employed in the receiver e.g., condensation polymers such as polyesters, polyurethanes, polycarbonates, etc.; addition polymers such as polystyrenes, vinyl polymers, etc.; block copolymers containing large segments of more than one type of polymer covalently linked together; provided such polymeric material contains acid groups either as part of the polymer chain or as a separately added organic acid. In a preferred embodiment of the invention, the dye image-receiving layer comprises a polyester, an acrylic polymer, a styrene polymer or a phenolic resin. In another preferred embodiment of the invention, the dye image-receiving layer comprises a polyester ionomer as described in copending application Ser. No. 08/469,132, filed of even date herewith, by Bowman, Shuttleworth and Weber, and entitled "Thermal Dye Transfer System With Polyester Ionomer Receiver".

The following receiver polymers may be used in accordance with the invention:

| | |
|---|---|
| Receiver 1 | poly(butyl acrylate-co-2-acrylamido-2-methyl-propanesulfonic acid) 75:25 |
| Receiver 2 | poly(2-ethylhexyl acrylate-co-2-acrylamido-2-methyl-propanesulfonic acid) 75:25 |
| Receiver 3 | poly(2-ethylhexyl methacrylate-co-2-acrylamido-2-methyl-propanesulfonic acid) 75:25 |
| Reciever 4 | poly(2-hexyl methacrylate-co-2-acylamido-2-methyl-propanesulfonic acid) 75:25 |
| Receiver 5 | poly(butyl acrylate-co-methylacrylic acid) 75:25 |
| Receiver 6 | poly(butyl acrylate-co-2-acrylamido-2-methyl-propanesulfonic acid-co-methyl 2-acrylamido-2-methoxyacetate) 65:25:10 |
| Receiver 7 | poly(hexyl methacrylate-co-2-sulfoethyl methacrylate-co-2-acrylamido-2-methoxyacetate) 65:25:10 |
| Receiver 8 | polystyrenesulfonic acid |
| Receiver 9 | poly(ethyl methacrylate-co-2-sulfoethyl methacrylate) 75:25 |
| Receiver 10 | poly(methyl methacrylate-co-2-sulfoethyl methacrylate) 75:25 |
| Receiver 11 | N-15 Novolak (a phenolic resin, Eastman Chemical Co.) |
| Receiver 12 | 3.23 g/m$^2$ Poly(2-phenylethyl methacrylate) (Scientific Polymer Products Inc.) containing 0.54 g/m$^2$ of 3,5-di-t-butylsalicyclic acid |
| Receiver 13 | 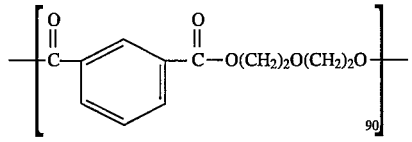 |

mole percent

-continued

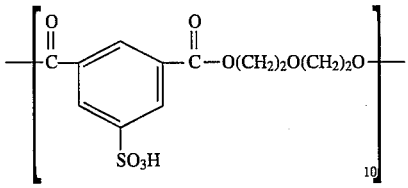

mole percent

The polymer in the dye image-receiving layer may be present in any amount which is effective for its intended purpose. In general, good results have been obtained at a concentration of from about 0.5 to about 10 g/m$^2$. The polymers may be coated from organic solvents or water, if desired.

The support for the dye-receiving element employed in the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of a dye precursor as described above capable of generating a magenta dye, a cyan and a yellow dye, and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLE 1

Preparation of N-arylimidoethyliene-benz[c,d]indole magenta dye precusor

A solution of 1.4 g (0.00436 mole) of 1-methyl- 2-(2-anilinovinyl)-benz[c,d]indolium chloride in 15 mL of methanol is added slowly to a mixture of 50 mL ethyl acetate, 20 mL 10% aqueous sodium carbonate and 10 mL 10% aqueous sodium hydroxide. The ethyl acetate layer is separated, washed with water and saturated sodium chloride and evaporated to dryness. Recrystallization of the residue from 15 mL methanol yields 0.9 g (72%) of Dye Precursor 1 as a brown solid. Other dye precursors of the invention can be prepared in an analogous manner.

EXAMPLE 2

Dye-donor elements were prepared by coating on a 6 μm poly(ethylene terephthalate) support:

1) a subbing layer of Tyzor TBT®, a titanium tetrabutoxide, (DuPont Company) (0.16 g/m$^2$) coated from 1-butanol; and 2) a dye layer containing dye precursors 1–5 of the invention and Control Dye C-1 and Control Dye C-2 shown below, and FC-431® fluorocarbon surfactant (3M Company) (0.01 g/m$^2$) in a Butvar® 76 poly(vinyl butyral) binder, (Monsanto Company) coated from a tetrahydrofuran and cyclopentanone solvent mixture (95:5).

Details of dye and binder laydowns are tabulated in Table 1 below. Dye levels were adjusted for differences in dye molecular weight and molar extinction coefficient to ensure a more accurate evaluation of transfer efficiency. The dye-:binder ratios were held constant.

On the back side of the dye-donor element was coated:

1) a subbing layer of Tyzor TBT®, a titanium tetrabutoxide, (DuPont Company) (0.16 g/m$^2$) coated from 1-butanol; and 2) a slipping layer of Emralon 329® (Acheson Colloids Co.), a dry film lubricant of poly(tetrafluoroethylene) particles in a cellulose nitrate resin binder (0.54 g/m$^2$)

and S-nauba micronized carnauba wax (0.016 g/m$^2$) coated from a n-propyl acetate, toluene, isopropyl alcohol and n-butyl alcohol solvent mixture.

TABLE 1

| Magenta Dye Precursor | Dye Laydown (g/m$^2$) | Binder Laydown (g/m$^2$) |
|---|---|---|
| 1 | 0.22 | 0.24 |
| 2 | 0.32 | 0.35 |
| 3 | 0.33 | 0.36 |
| 4 | 0.26 | 0.28 |
| 5 | 0.28 | 0.30 |
| C-1 | 0.22 | 0.24 |
| C-2 | 0.26 | 0.28 |

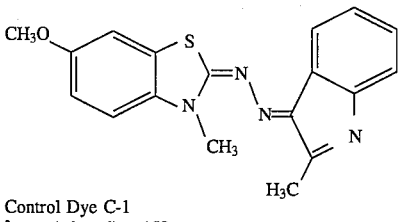

Control Dye C-1
λ-max(ethanol) = 459
λ-max(ethanol + HCl) = 522
(ε = 44,700)
molecular weight = 336

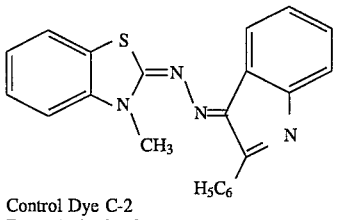

Control Dye C-2
Example 9 of U.S. Pat. No. 4,137,042
λ-max(ethanol) = 464
λ-max(ethanol + HCl) = 539
(ε = 43,700)
molecular weight = 368

Preparation and Evaluation of Dye-Receiver Elements

Dye-receiver elements according to the invention were prepared by first extrusion laminating a paper core with a 38μ thick microvoided composite film (OPPalyte 350TW®, Mobil Chemical Co.) as disclosed in U.S. Pat. No. 5,244,861. The composite film side of the resulting laminate was then coated with the following layers in the order recited:

1) a subbing layer of Polymin Waterfree® polyethyleneimine (BASF, 0.02 g/m$^2$), and
2) a dye-receiving layer composed of the receiver polymer 13 above (5.38 g/m$^2$) and a fluorocarbon surfactant (Fluorad FC-170C®, 3M Corporation, 0.022 g/m$^2$) coated from water.

Preparation and Evaluation of Thermal Dye Transfer Images

Eleven-step sensitometric thermal dye transfer images were prepared from the above dye-donor and dye-receiver elements. The dye side of the dye-donor element approximately 10 cm×15 cm in area was placed in contact with the dye image-receiving layer side of a dye-receiving element of the same area. This assemblage was clamped to a stepper motor-driven, 60 mm diameter rubber roller. A thermal head (TDK No. 8I0625, thermostatted at 31° C.) was pressed with a force of 24.4 newtons (2.5 kg) against the dye-donor element side of the assemblage, pushing it against the rubber roller.

The imaging electronics were activated causing the donor-receiver assemblage to be drawn through the printing head/roller nip at 11.1 mm/s. Coincidentally, the resistive elements in the thermal print head were pulsed (128 μs/pulse) at 129 μs intervals during a 16.9 μs/dot printing cycle. A stepped image density was generated by incrementally increasing the number of pulses/dot from a minimum of 0 to a maximum of 127 pulses/dot. The voltage supplied to the thermal head was approximately 9.25 v resulting in an instantaneous peak power of 0.175 watts/dot and a maximum total energy of 2.84 mJ/dot.

After printing, each dye-donor element was separated from the imaged receiving element and the Status A green reflection density of each of the eleven steps in the stepped-image was measured with a reflection densitometer. The maximum reflection density is listed in Table 2.

TABLE 2

| Magenta Dye Precursor | Maximum Transferred Reflection Density (Status A Green) |
|---|---|
| 1 | 1.9 |
| 2 | 2.6 |
| 3 | 2.3 |
| 4 | 2.8 |
| 5 | 3.1 |
| C-1 | 1.6 |
| C-2 | 1.7 |

As the above results show, the N-arylimidoethylidene benz[c,d]indole magenta dye precursors of the invention provide higher maximum transferred densities (are more efficient) than the magenta dye precursors of the prior art.

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye comprising an N-arylimidoethylidene-benz[c,d]indole dye precursor, and (b) a dye-receiving element comprising a support having thereon a polymeric dye image-receiving layer, said dye-receiving element being in a superposed relationship with said dye-donor element so that said dye layer is in contact with said dye image-receiving layer, said dye image-receiving layer containing an organic acid which is capable of converting said dye precursor into a cationic magenta anilinovinyl-benz[c,d]indolium dye.

2. The assemblage of claim 1 wherein said polymeric dye image-receiving layer comprises a polyester, an acrylic polymer, a styrene polymer or a phenolic resin.

3. The assemblage of claim 1 wherein said polymeric dye image-receiving layer comprises a polymer containing an organic acid moiety as part of the polymer chain.

4. The assemblage of claim 3 wherein said organic acid comprises a sulfonic acid, a carboxylic acid, a phosphonic acid, a phosphoric acid or a phenol.

5. The assemblage of claim 1 wherein said polymeric dye image-receiving layer contains a ballasted organic acid.

6. The assemblage of claim 5 wherein said ballasted organic acid comprises a salicylic acid, a sulfonic acid, a carboxylic acid, a phosphonic acid, a phosphoric acid or a phenol.

7. The assemblage of claim 1 wherein said dye precursor has the general formula:

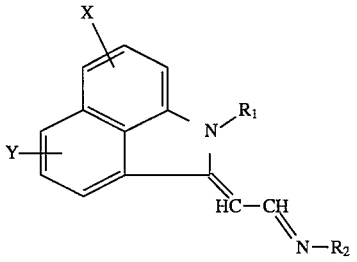

wherein:

$R_1$ represents an alkyl group of 1–10 carbon atoms, a cycloalkyl group of 5–8 carbon atoms an, aryl group of 6–10 carbon atoms, a hetaryl group of 5–10 atoms or an allyl group;

$R_2$ represents a substituted or unsubstituted aryl group of 6–10 carbon atoms or a hetaryl group of 5–10 atoms; and X and Y each independently represents hydrogen or one or more groups selected from halogen, cyano, alkyl, aryl, hetaryl, nitro, carboxy, alkoxy, aryloxy, alkoxycarbonyl, aryloxycarbonyl, acyloxy, aryloxy, amino, acylamino, arylsulfonamido, alkylsulfonamido, hydroxy, alkylcarbamoyl, dialkylcarbamoyl, arylcarbamoyl, diarylcarbamoyl, arylalkylcarbamoyl, alkylureido, arylureido, alkylthio and arylthio.

8. The assemblage of claim 7 wherein $R_1$ is $CH_3$, $R_2$ is phenyl, 2,4-dimethoxyphenyl, 2-methoxyphenyl, 4-methoxyphenyl or 2,5-dichlorophenyl, and X and Y are both hydrogen.

9. A process of forming a dye transfer image comprising imagewise-heating a dye-donor element comprising a support having thereon a dye layer comprising a dye dispersed in a polymeric binder, said dye comprising an N-arylimidoethylidene-benz[c,d]indole dye precursor, and imagewise transferring said dye to a dye-receiving element to form said dye transfer image, said dye-receiving element comprising a support having thereon a polymeric dye image-receiving layer, said dye image-receiving layer containing an organic acid which is capable of converting said dye precursor into a cationic magenta anilinovinyl-benz[c,d]indolium dye.

10. The process of claim 9 wherein said polymeric dye image-receiving layer comprises a polyester, an acrylic polymer, a styrene polymer or a phenolic resin.

11. The process of claim 9 wherein said polymeric dye image-receiving layer comprises a polymer containing an organic acid moiety as part of the polymer chain.

12. The process of claim 11 wherein said organic acid comprises a sulfonic acid, a carboxylic acid, a phosphonic acid, a phosphoric acid or a phenol.

13. The process of claim 9 wherein said polymeric dye image-receiving layer contains a ballasted organic acid.

14. The process of claim 13 wherein said ballasted organic acid comprises a salicylic acid, a sulfonic acid, a carboxylic acid, a phosphonic acid, a phosphoric acid or a phenol.

15. The process of claim 9 wherein said dye precursor has the general formula:

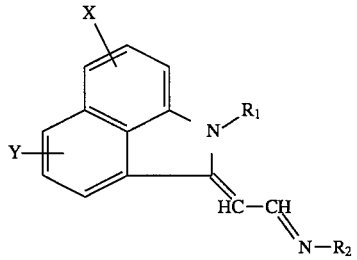

wherein:

$R_1$ represents an alkyl group of 1–10 carbon atoms, a cycloalkyl group of 5–8 carbon atoms, an aryl group of 6–10 carbon atoms, a hetaryl group of 5–10 atoms or an allyl group;

$R_2$ represents a substituted or unsubstituted aryl group of 6–10 carbon atoms or a hetaryl group of 5–10 atoms; and X and Y each independently represents hydrogen or one or more groups selected from halogen, cyano, alkyl, aryl, hetaryl, nitro, carboxy, alkoxy, aryloxy, alkoxycarbonyl, aryloxycarbonyl, acyloxy, aryloxy, amino, acylamino, arylsulfonamido, alkylsulfonamido, hydroxy, alkylcarbamoyl, dialkylcarbamoyl, arylcarbamoyl, diarylcarbamoyl, arylalkylcarbamoyl, alkylureido, arylureido, alkylthio and arylthio.

16. The process of claim 15 wherein $R_1$ is $CH_3$, $R_2$ is phenyl, 2,4-dimethoxyphenyl, 2-methoxyphenyl, 4-methoxyphenyl or 2,5-dichlorophenyl, and X and Y are both hydrogen.

* * * * *